US008308618B2

(12) United States Patent
Bayerlein et al.

(10) Patent No.: US 8,308,618 B2
(45) Date of Patent: Nov. 13, 2012

(54) TREADMILL WITH INTEGRATED WALKING REHABILITATION DEVICE

(75) Inventors: Douglas G. Bayerlein, Oconomowoc, WI (US); Nicholas A. Oblamski, Waukesha, WI (US); Vance E. Emons, Hartland, WI (US); Robert L. Zimpel, Menomonee Falls, WI (US); Scott D. Hoerig, Brookfield, WI (US)

(73) Assignee: Woodway USA, Inc., Waukesha, WI (US)

( * ) Notice: Subject to any disclaimer, the term of this patent is extended or adjusted under 35 U.S.C. 154(b) by 0 days.

(21) Appl. No.: 12/757,725

(22) Filed: Apr. 9, 2010

(65) Prior Publication Data

US 2010/0285929 A1 Nov. 11, 2010

Related U.S. Application Data

(60) Provisional application No. 61/168,512, filed on Apr. 10, 2009.

(51) Int. Cl.

| | |
|---|---|
| ***A63B 22/02*** | (2006.01) |
| ***A61H 1/00*** | (2006.01) |
| ***A61H 1/02*** | (2006.01) |
| ***A61H 5/00*** | (2006.01) |

(52) U.S. Cl. ..... 482/54; 601/34; 601/35

(58) Field of Classification Search ..... 482/1–9, 482/51–52, 54, 66, 69–70, 79–80, 111, 133–139, 482/142, 145, 901; 119/700; 434/247, 255; 601/5, 23, 33–36; *A63B 22/02; A61H 1/00, A61H 1/02, 5/00*

See application file for complete search history.

(56) References Cited

U.S. PATENT DOCUMENTS

| | | | | |
|---|---|---|---|---|
| 219,439 | A | 9/1879 | Blend | |
| 4,204,673 | A * | 5/1980 | Speer, Sr. | 482/5 |
| 4,614,337 | A | 9/1986 | Schönenberger | |
| 5,470,293 | A | 11/1995 | Schönenberger | |

(Continued)

FOREIGN PATENT DOCUMENTS

| | | |
|---|---|---|
| AU | 2007302381 B2 | 4/2008 |

(Continued)

OTHER PUBLICATIONS

Rehabilitation Robotics. Copyright 2009 by Fraunhofer IPK. Accessed Mar. 26, 2010. http://www.ipk.fraunhofer.de/rehabrobotics. 1 page.

(Continued)

*Primary Examiner* — Oren Ginsberg
(74) *Attorney, Agent, or Firm* — Foley & Lardner LLP

(57) ABSTRACT

A treadmill for providing walking rehabilitation to a rehabilitee is provided including a base including a belt and a walking rehabilitation device interconnected with the base. The walking rehabilitation device includes a user engagement structure extending at least partially above the belt and being configured to be removably secured relative to one or more locations of a rehabilitee's lower extremities. The walking rehabilitation device further includes a plurality of drive systems coupled to the user engagement structure. The drive systems include at least a first drive system controlling the rehabilitee's motion in a first direction and a second drive system controlling the rehabilitee's motion in a second direction. The treadmill further includes one or more motors coupled to and driving the plurality of drive systems. The motion from the drive systems is transferred to the rehabilitee by the user engagement structure, allowing the rehabilitee to walk along the belt.

22 Claims, 11 Drawing Sheets

U.S. PATENT DOCUMENTS

| | | | | |
|---|---|---|---|---|
| 5,577,598 | A | 11/1996 | Schoenenberger | |
| 6,146,315 | A | 11/2000 | Schönenberger | |
| 6,348,025 | B1 | 2/2002 | Schönenberger | |
| 6,666,831 | B1 * | 12/2003 | Edgerton et al. | 600/587 |
| 6,689,075 | B2 * | 2/2004 | West | 601/23 |
| 6,796,926 | B2 * | 9/2004 | Reinkensmeyer et al. | 482/8 |
| 6,821,233 | B1 * | 11/2004 | Colombo et al. | 482/54 |
| 7,041,069 | B2 * | 5/2006 | West | 601/5 |
| 7,331,906 | B2 * | 2/2008 | He et al. | 482/69 |
| 2006/0229167 | A1 * | 10/2006 | Kram et al. | 482/54 |
| 2008/0249438 | A1 * | 10/2008 | Agrawal et al. | 601/35 |
| 2008/0255488 | A1 * | 10/2008 | Agrawal et al. | 602/23 |
| 2009/0215589 | A1 | 8/2009 | Schoenenberger | |
| 2009/0306548 | A1 * | 12/2009 | Bhugra et al. | 600/587 |
| 2010/0152629 | A1 * | 6/2010 | Haas et al. | 601/34 |
| 2010/0298102 | A1 * | 11/2010 | Bosecker et al. | 482/54 |

FOREIGN PATENT DOCUMENTS

| | | | |
|---|---|---|---|
| DE | 25 03 118 | | 4/1976 |
| DE | 298 18 870 | | 1/2000 |
| EP | 0 218 8 | A1 | 6/1979 |
| EP | 0 364 992 | A2 | 10/1989 |
| WO | WO 98/10839 | | 3/1998 |

OTHER PUBLICATIONS

Schmidt, Henning, R. Riener. Rehabilitation Robotics. Copyright 2009 by Fraunhofer IPK. Research areas. Accessed Mar. 26, 2010. http://www.ipk.fraunhofer.de/rehabrobotics/research. 5 pages.

Rehabilitationstechnologien mit Hand and Fuβ. Copyright 2009 by Reha-Stin. Accessed Mar. 26, 2010. http://www.reha-stim.de/cms/index.php?id=48. 1 page.

The ALTACRO Project. Published 2006 by Virje Universiteit Brussel. Accessed Mar. 26, 2010. http://altacro.vub.ac.be/info/project.htm. 1 page.

* cited by examiner

TREADMILL WITH INTEGRATED WALKING REHABILITATION DEVICE

CROSS-REFERENCE TO RELATED PATENT APPLICATIONS

This application claims priority from U.S. Provisional Application Ser. No. 61/168,512, filed Apr. 10, 2009, titled "Integrated Treadmill and Walking Aid," which is incorporated herein by reference in its entirety.

BACKGROUND

The present invention relates to the use of rehabilitation therapy that mimics walking (also referred to as, "walking therapy"). More specifically, the present invention relates to the use of a treadmill to provide walking therapy.

A number of disorders and injuries may cause an individual to experience complications when walking or render them unable to walk. For example, an individual may experience neurological damage due to stroke, spinal cord injury, etc. Walking therapy can help these individuals improve and/or regain their walk or gait. Such improvements may be the result of improving the training of muscle groups, improving kinesthetic awareness, and other related factors.

Walking therapy has traditionally been conducted with the help of two or more therapists that manually move a rehabilitee's legs to mimic walking motions. These traditional methods have a number of shortcomings. Among other things, these methods are very labor-intensive on the part of the physical therapists and can be subject to significant variability (e.g., due to different physical therapists working on different parts of a patient's legs, the inability to precisely control the gait of the patient's legs, etc.).

Generally, it is desirable to have more consistency when providing walking therapy. In some cases, consistency allows improvements to be more readily realized. In other cases, the results achieved are more accurate (e.g., because substantially the same muscle groups are repeatedly trained in substantially the same way, without undesirable variations, such as those occurring when a physical therapist's arms are tired, etc.). More recently, mechanically and/or robotically assisted devices that provide walking rehabilitation have been found to provide improved consistency.

SUMMARY

According to one embodiment a treadmill for providing walking rehabilitation to a rehabilitee comprises a base including a belt and a walking rehabilitation device interconnected with the base. The walking rehabilitation device comprises a user engagement structure extending at least partially above the belt and being configured to be removably secured relative to one or more locations of a rehabilitee's lower extremities; a plurality of drive systems coupled to the user engagement structure, the plurality of interconnected drive systems including at least a first drive system controlling the rehabilitee's motion in a first direction and a second drive system controlling the rehabilitee's motion in a second direction; and one or more motors coupled to and driving the plurality of drive systems, wherein motion from the plurality of drive systems is transferred to the rehabilitee by the user engagement structure, allowing the rehabilitee to walk along the belt.

According to another embodiment a method for providing walking rehabilitation to a rehabilitee, comprises providing a treadmill with a base, a belt, and a walking rehabilitation device, the walking rehabilitation device interconnected with the base and including plurality of drive systems operably interconnected with a user engagement structure; removably securing the user engagement structure relative to one or more locations of a rehabilitee's lower extremities; driving the plurality of drive systems with a plurality of servo motors; and imparting motion to the rehabilitee, causing them to walk along the belt with a desirable gait.

DETAILED DESCRIPTION

Figure 1:
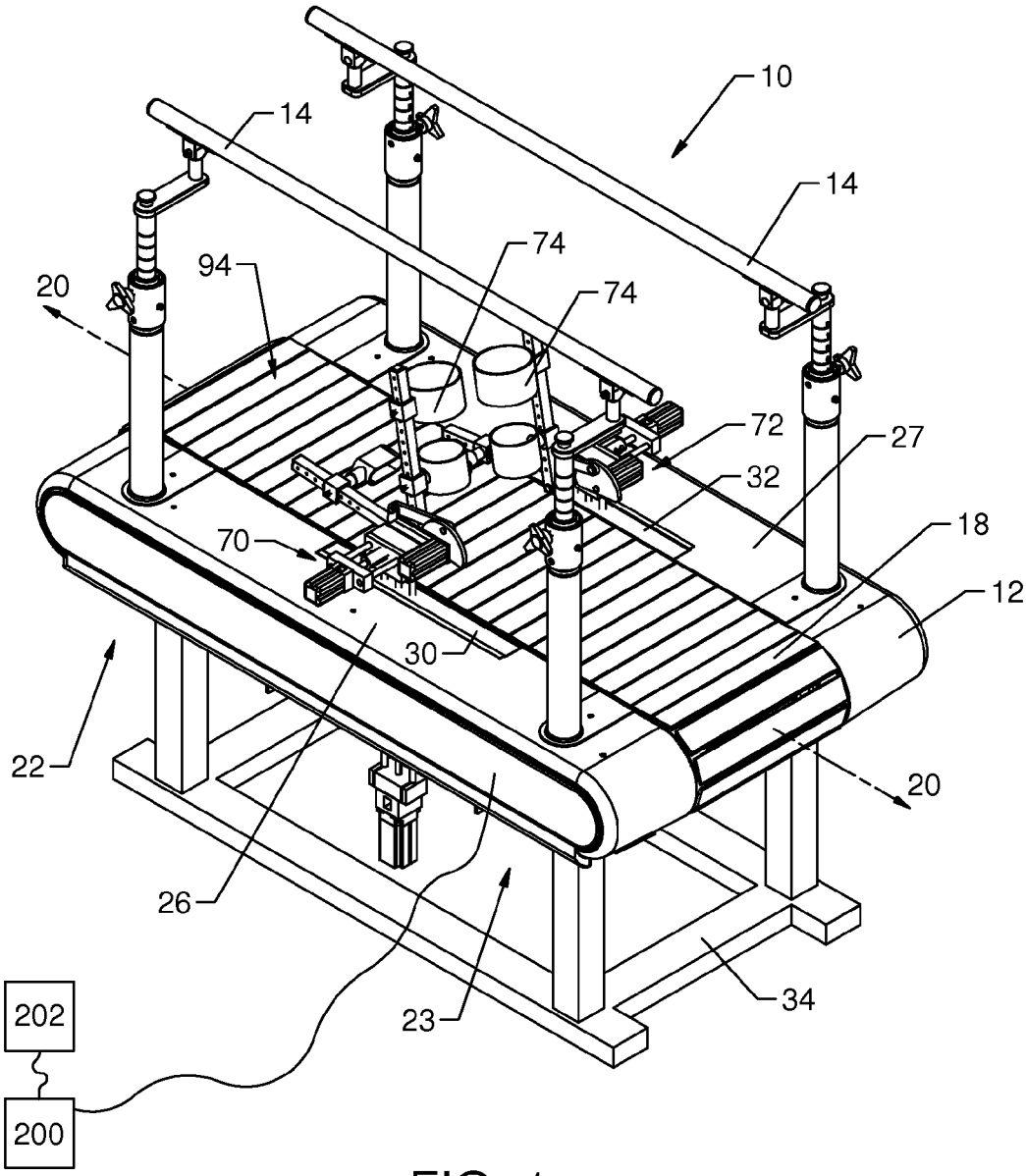
FIG. 1 is a perspective view of a treadmill including an integrated walking rehabilitation device according to a first exemplary embodiment.

FIG. 1 shows a treadmill 10 generally comprising a base 12, one or more handrails 14 mounted to the base 12, and an integrated walking rehabilitation device 16 according to an exemplary embodiment. The walking rehabilitation device 16 is configured to help a rehabilitee to restore or improve their gait by guiding the rehabilitee's lower extremities to move according to a desirable gait pattern. With repeated use, the walking rehabilitation device 16 may, among other things, help a rehabilitee relearn to walk in a physically correct matter, improve the their muscle function, improve their muscle memory, and improve their kinesthetic awareness, as will be discussed in more detail below.

Figure 2:
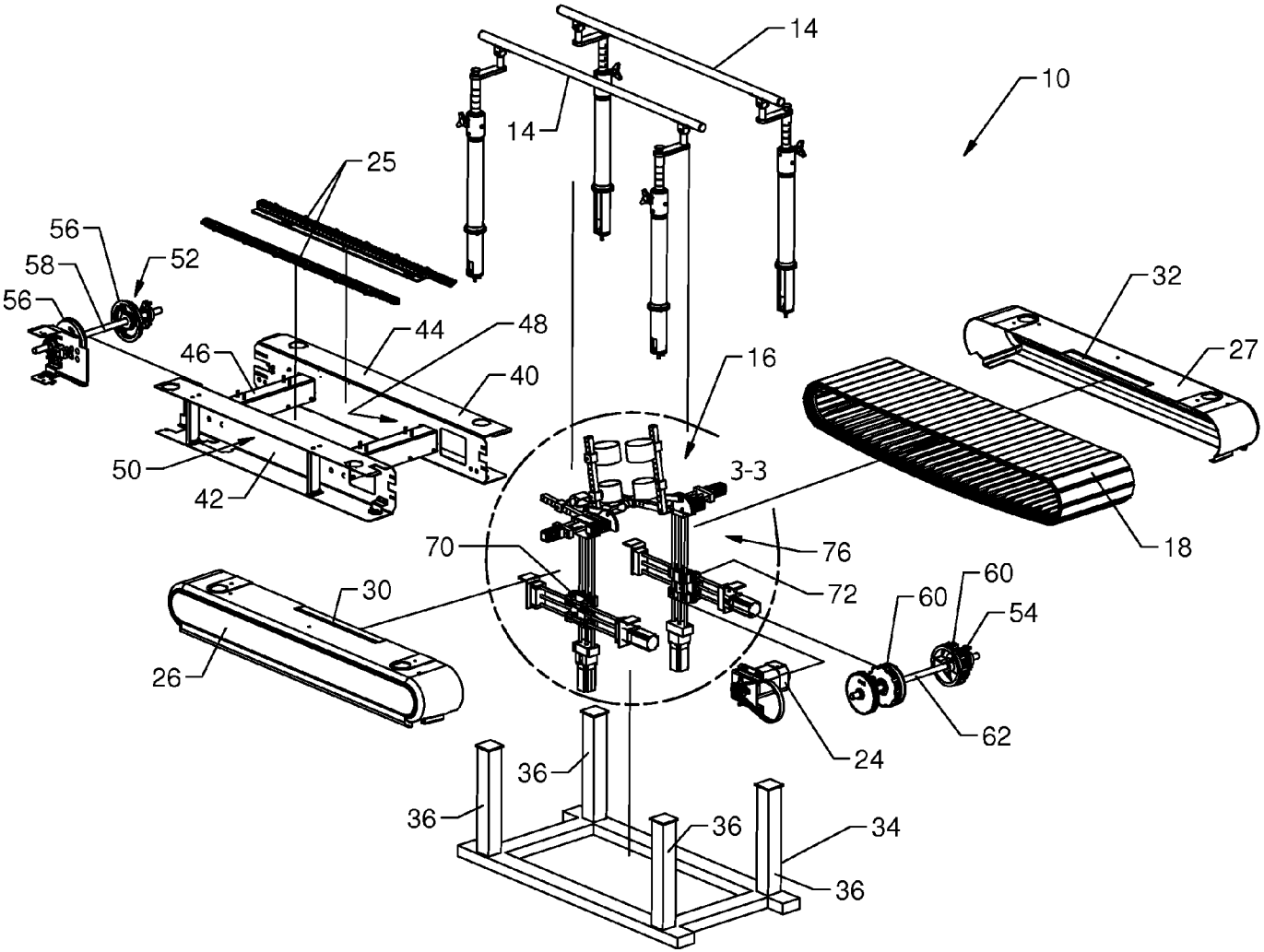
FIG. 2 is an exploded view of the treadmill including an integrated walking rehabilitation device according to the exemplary embodiment shown in FIG. 1.

The base 12 includes a belt 18 that extends substantially longitudinally along a longitudinal axis 20. The longitudinal axis 20 extends generally between a front end 22 and a rear end 23 of the treadmill 10; more specifically, the longitudinal axis 20 extends generally between the centerlines of a front and rear shaft, which will be discussed in more detail below. The belt 18 is driven longitudinally by a drive motor 24 and is guided by a pair of bearing rails 25 (see FIG. 2 illustrating the drive motor 24 and the bearing rails 25). The speed at which the belt 18 is driven by the drive motor 24 may be adjusted (e.g., using buttons on a display, using a computer, etc.).

A pair of side panels 26 and 27 (e.g., covers, shrouds, etc.) are provided on the right and left sides of the base 12 to effectively shield the rehabilitee from the components or moving parts of the treadmill 10. Openings 30 and 32 in the side panels 26, 27 allow for a structure of the walking rehabilitation device 16 to extend above the belt 18 to be operatively coupled to the rehabilitee in the exemplary embodiment shown. It should be noted that brushes or other similar elements may be disposed in the openings to help prevent undesired objects from entering the openings.

The treadmill 10 is shown further including a support structure, shown as a stand 34, disposed generally beneath the base 12 according to an exemplary embodiment. The stand 34 provides clearance for the moving components, in particular the vertically movable components, of the walking rehabilitation device 16. In the exemplary embodiment shown, the stand 34 includes a plurality of support members, including four support legs 36 that raise the base a distance off the ground. The moving components of the walking rehabilitation device 16, which are movably coupled to the base 12, are correspondingly raised a distance off the ground. It should be noted that the support may have any configuration suitable to accommodate the moving parts of the walking rehabilitation device. According to some exemplary embodiments, a pit installation may be used, typically with the stand. In one exemplary embodiment, a pit installation involves forming a pit (e.g., opening, cavity, hole, etc.) in the ground of the space in which the treadmill will be located. The treadmill is disposed generally above the pit and the moving components of the walking rehabilitation system are accommodated within the pit. In some of these configurations, this allows the base of the treadmill to be positioned substantially flush with the ground, thereby allowing a physical therapist or other person to more readily assist the rehabilitee. In another exemplary embodiment, a raised platform may be built-up around the treadmill.

The handrails 14 are shown extending along the right-hand and left-hand sides of the treadmill 10 generally parallel to the longitudinal axis 20. A rehabilitee may utilize the handrails 14 for support (e.g., keeping themselves upright, partially supporting the weight of their body, etc.). Further, the handrails 14 may be configured to be adjustable, to accommodate users of different heights, builds, etc. According to other exemplary embodiments, other devices configured to support or allow one to support at least part of the weight of the rehabilitee may be utilized with the treadmill 10 (e.g., a mechanical counterweight, a pneumatic device, a servo-controlled device, etc.) alone or in combination with the handrails 14 and/or handrails having other suitable configurations. These devices may be removable or integrated with the treadmill 10. It should be noted that the left and right-hand sides of the treadmill and various components thereof are defined from the perspective of a forward-facing user standing on the running surface of the treadmill 10.

Referring to FIG. 2, the base 12 is shown including a frame 40 that comprises longitudinally-extending, opposing side members, shown as a left-hand side member 42 and a right-hand side member 44, and one or more lateral or cross-members 46 extending between and structurally connecting the side members 42 and 44 according to an exemplary embodiment. Each side member 42, 44 includes an inner surface 48 and an outer surface 50. The inner surface 48 of the left-hand side member 42 is opposite to and faces the inner surface 48 of the right-hand side member 44. According to other exemplary embodiments, the frame may have substantially any configuration suitable for providing structure and support for the treadmill.

A front shaft assembly 52 and a rear shaft assembly 54 are coupled to the frame 40 according to an exemplary embodiment. The front shaft assembly 52 includes a pair of front belt pulleys 56 interconnected with, and preferably directly mounted to, a front shaft 58, and the rear shaft assembly 54 includes a pair of rear belt pulleys 60 interconnected with, and preferably directly mounted to, a rear shaft 62. The front and rear belt pulleys 56, 60 are configured to support and facilitate movement of the belt 18. The belt 18 is disposed about the front and rear belt pulleys 56, 60, which are preferably fixed to the front and rear shafts 58, 62. As the drive motor 24 drives the rear shaft 62, the rear belt pulleys 60 rotate, causing the belt 18 and the front belt pulleys 56 to rotate in the same direction. According to other exemplary embodiments, the motor may be operatively coupled to the front shaft and the drive belt.

Referring generally to FIGS. 1-4, the walking rehabilitation device 16 includes a left-hand structure 70 and a right hand-structure 72, each including a user engagement structure 74 coupled to, and more preferably operably interconnected with, a plurality of drive systems 76 according to an exemplary embodiment. In the exemplary embodiment shown, the right-hand structure 72 is coupled, and preferably directly mounted, to the right-hand side member 44 of the frame 40, and the left-hand structure 70 is coupled, and preferably directly mounted, to the left hand side member 42 of the frame 40. It should be noted that the user engagement structures at the left-hand side and the right-hand side may be referred to collectively as the user engagement structure.

The user engagement structure 74 is configured to be removably secured relative to desirable locations of the rehabilitee's lower extremities in order to transfer motion from the plurality of drive systems 76 to the rehabilitee, causing them to walk with a desirable gait. The user engagement structure 74 is coupled to, and preferably interconnected with, the plurality of drive systems 76. At each of the right-hand structure 72 and the left-hand structure 70 of the walking rehabilitation device 16, one or more support or coupling features, shown as straps 78, 80, 82, releasably secure the user engagement structure 74 relative to the left leg or foot and the right leg or foot of the rehabilitee, respectively. In this way, driving force from the plurality of drive systems 76 can be transferred from the walking rehabilitation device 16 to the rehabilitee.

In the exemplary embodiment shown, the straps 78 and 80 are intended to be disposed about the rehabilitee's shins and the strap 82 is intended to be disposed about the rehabilitee's foot (e.g., at a location substantially corresponding to the arch of the wearer's foot, etc.). In some exemplary embodiments, the straps may be adjustable (e.g., using one or more fastening elements such as Velcro® or snaps), to adjust the fit of the straps relative to the rehabilitee's body. In some exemplary embodiments, the straps may be elastic or stretchable, facilitating a relatively tight fit about a desired portion of the rehabilitee's body. According to still other exemplary embodiments, any suitable support or coupling features may be used.

The relative positions of the straps 78, 80, 82 are also adjustable according to an exemplary embodiment. The straps 78 and 80 are shown coupled to a first support member 84, and strap 82 is shown coupled to a second support member 86. Each member 84, 86 includes a plurality of holes 88 (e.g., openings, apertures, etc.). A fastener, shown as a pin 90, is receivable in any of holes 88, and may be positioned through a portion of the straps and into one of the holes 88 to couple a strap at a desired location relative to one of members 84, 86. The adjustability of the relative positions of the straps helps better accommodate rehabilitees having different builds, body types, proportions, etc. According to other exemplary embodiments, other suitable adjustment mechanisms may be used (e.g., slidable mechanisms, snapping mechanisms, etc.). According to still other exemplary embodiments, one or more support or coupling features of the user engagement structure are not adjustable.

Articulating features, shown as shafts 92, may be included in the straps 78, 80, 82 or otherwise incorporated into the user engagement structure 74 to enable the portions of the rehabilitee's extremities coupled to the user engagement structure 74 to move relative to the first support member 84 and second support member 86. Further, the shafts 92 may help facilitate movement of the user's shin relative to their foot. In this way, the shafts 92 allow a rehabilitee to move with more natural movement when using the walking rehabilitation device 16 and/or to be more comfortably accommodated therein. It should be noted that, in the exemplary embodiment shown, the shaft 92 corresponding to the strap 82, also provides for lateral movement, allowing lateral articulation of the rehabilitee's ankle. According to some exemplary embodiments, other features may be incorporated to allow for this movement.

While the coupling features are shown configured to be coupled relative to a rehabilitee's shins and feet, the coupling features may be positioned relative to or about any desirable combination of locations of the rehabilitee's lower extremities (e.g., shins, arches of the feet, calves, heels, etc.). According to some exemplary embodiments, additional coupling features may be provided that are coupled to the user's upper extremities (e.g., waist, chest, arms, etc.), such as a harness. According to other exemplary embodiments, any device suitable for substantially securing the rehabilitee to the walking rehabilitation device and providing for motion to be imparted to the rehabilitee's lower extremities may be used. For example, the user engagement structure may include boots and clamping devices according to another exemplary embodiment.

Figure 3:
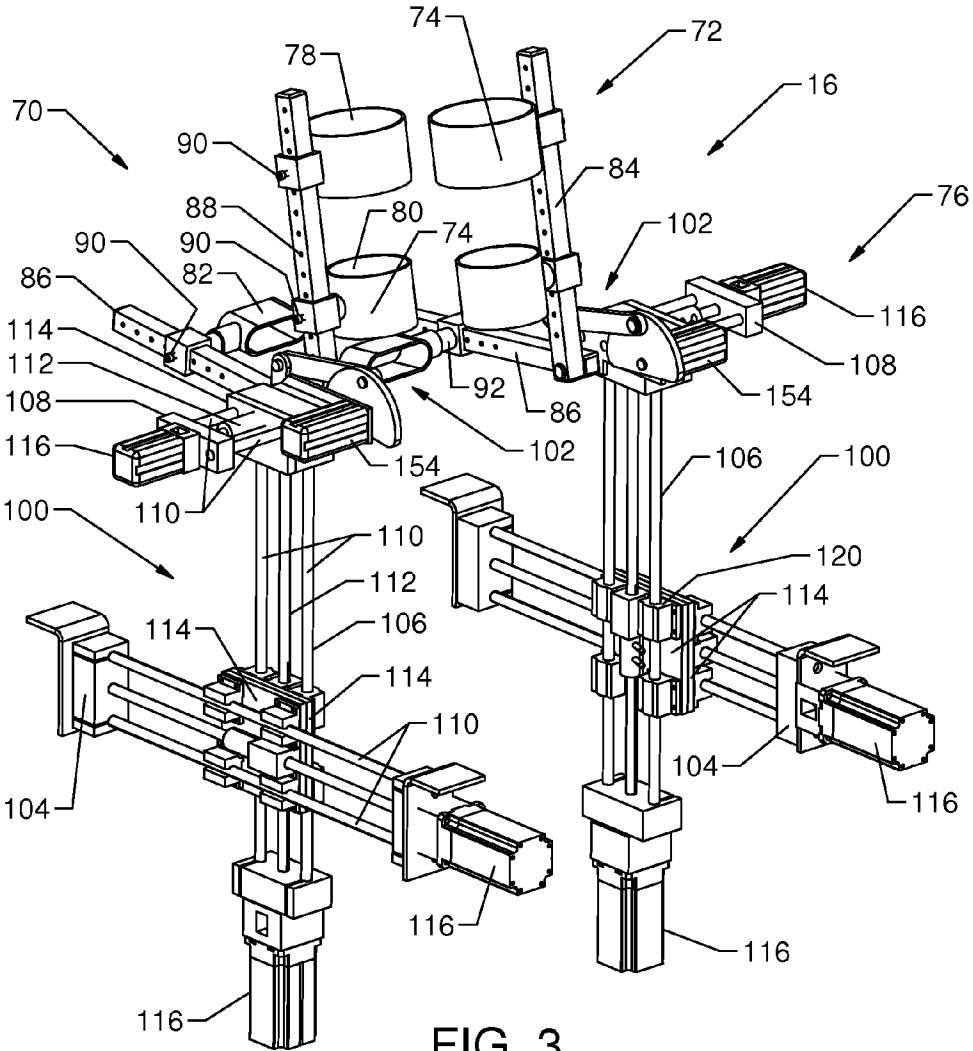
FIG. 3 is a perspective view of the walking rehabilitation device according to the exemplary embodiment shown in FIG. 1.

Referring to FIGS. 2-3, the plurality of drive systems 76 are configured to provide for movement of the lower extremities of the rehabilitee in a desired gait pattern. As the drive systems 76 provide movement to the rehabilitee, the rehabilitee walks along a surface 94 the belt 18. The movement of the belt 18 allows the rehabilitee to remain at a substantially stationary location (i.e., along the surface 94 of the belt 18) so that physical therapists can easily monitor and assist the rehabilitee.

The plurality of drive systems 76 are shown preferably including two or more linear drive systems 100 and an ankle articulation drive system 102 according to an exemplary embodiment. The linear drive systems 100 include a pair of longitudinal drive systems 104, a pair of vertical drive systems 106, and a pair of horizontal or lateral drive systems 108 according to an exemplary embodiment. The longitudinal drive systems 104 are configured to provide motion in a direction along or parallel to the longitudinal axis 20 and the surface 94 of the belt 18. The vertical drive systems 106 are configured to provide motion in a direction perpendicular to the longitudinal axis 20 and the surface 94 of the belt 18, generally aligned with the force of gravity. The lateral drive systems 108 are configured to provide for side-to-side motion relative to the surface 94 of the belt 18 between the right-hand side and the left-hand side of the treadmill 10. Utilized in combination, a desirable and physically correct gait pattern can be achieved. Further, this gait pattern may be varied or adjusted depending on the rehabilitee and/or the desired rehabilitative treatment, as will be discussed in more detail later.

Each linear drive system 100 is shown including one or more substantially linear members, shown as rails 110 and drive screws 112, one or more guides 114 movable along the rails 110, and a servo motor 116 according to an exemplary embodiment. The rails 110 (e.g., shafts, bars, tracks, beams, etc.) and drive screws 112 generally define the path traveled by the guides 114, and the guides are movable therealong. More specifically, the servo motor 116 is coupled to and rotatably drives the drive screw 112 of each linear drive system 100, which, in turn, causes the guide 114 to advance or retreat along the rails 110. It should be noted that variations of the linear drive system shown are contemplated. For example, two drive screw may be used with one rail, a single drive screw may be used, etc. Further, while in the embodiment shown each linear drive system is shown including three linear members, other numbers of linear members may be utilized (e.g., one, two, four, etc.). According to the exemplary embodiment shown, the linear drive systems are PowerTrax™ Series 200 slide systems by Nook Industries. According to other exemplary embodiments other suitable linear drive systems may be utilized. According to still other exemplary embodiments, guides including one or more curved portions may be utilized.

The guides 114 are shown including one or more receiving features, shown as apertures 120, corresponding to the relative locations of the rails 110 and configured to receive the rails 110 and drive screws 112 therein, facilitating the slidable movement of the guides 114 relative to the rails 110. The aperture 120 corresponding to the drive screw 112 is threaded to correspond to a plurality of threads of the drive screw 112. In this way, rotation of the drive screw 112 imparts linear motion to the guide 114. According to other exemplary embodiments, the guides may receive the rails in any fashion suitable to allow for slidable movement of the guides along the rails. For example, in some exemplary embodiments, the guides may include wheels, bearings, or other rotatable elements that facilitate movement along the rails.

The linear drive systems 100 may further include stops, shown as a pair of opposing blocks 124, defining the maximum range of movement of the guides 114 in the direction in which the rails 110 are oriented (e.g., longitudinally, vertically, etc.). The rails 110 and the drive screws 112 extend between and are at least partially supported by the blocks 124. Preferably, the rails 110 are directly mounted to the blocks 124 and the drive screws 112 are removably received in a pair of apertures disposed in the blocks 124 that allow for rotational movement of the drive screws 112 relative thereto. According to other exemplary embodiments, stops other than blocks may be used and/or the motion of the guides may be restricted in other ways.

The servo motor 116 is coupled, or preferably directly mounted, to a block at one of a first end 126 or a second end 128 of each linear drive systems 100. The servo motors 116 are configured to help control and change the mechanical position of the guides 114 in response to inputs. A shaft 130 of each servo motor is coupled to the drive screw 112 of each linear drive system 100, rotation of the shaft 130 imparting rotation to the drive screw 112. Typically, mimicking a walking motion involves the drive mechanisms at the right-hand side being at a different point in the gait pattern than the left-hand side at substantially all times. Accordingly, the ability to independently control the mechanical position of each linear drive system at both the right and left-hand sides of the treadmill 10 with the servo motors 116 is desirable and allows for desired gait patterns to be fairly accurately replicated, as discussed in more detail below. The servo motor is, for example, a BSMN Series motor by Baldor Electric Company, but other suitable servo motors may be used. It should be noted that in alternative exemplary embodiments, a single servo motor may help control and change the position of the guides of more than one linear drive system. It also should be noted that motors other than servo motors may be used with one or more linear drive systems according to some exemplary embodiments.

Each of the right-hand structure 72 and the left-hand structure 70 of the walking rehabilitation system 16 include one longitudinal drive system 104, one vertical drive system 106, and one lateral drive system 108 that are positioned to correspond to the left-hand side member 42 and the right-hand side member 44 of the frame 40 according to an exemplary embodiment. The drive systems disposed along the right-hand side generally impart motion to the right-hand side of the rehabilitee's body, and the drive systems disposed along the left-hand side generally impart motion to the left-hand side of the rehabilitee's body.

The linear drive systems 100 at the left-hand structure 70 and the right-hand structure 72 are interconnected, such that motion having components in any combination of directions may be fluidly imparted to the rehabilitee. Discussing the right-hand structure 72, which is the mirror image of the left-hand structure 70, by way of example and not be way of limitation, the arrangement and interconnection of the drive systems 104, 106, 108 will now be addressed. The longitudinal drive system 104 is disposed adjacent to the inner surface 48 of the right-hand side member 44 of the frame 40 and directly mounted thereto (e.g., at blocks 124). The vertical drive system 106 is interconnected with the longitudinal drive system 104 such that a surface 136 of the guide 114 of the vertical drive system 106 is coupled, and preferably directly mounted, to a surface 138 of the guide 114 of the longitudinal drive system 104. Accordingly, the vertical drive system 106 moves longitudinally in response to the movement of the longitudinal drive system 104. The servo motor 116 of the vertical drive system 106 drives the drive screw 112 and the rails 110 of the vertical drive system 106 relative to the guide of the vertical drive system 106, which, as mentioned above, is substantially fixed relative to the guide 114 of the are slidably moveable relative thereto. The lateral drive system 108 is coupled to the vertical drive system 106 at least partially above the belt 18, the block 124 at the first end 126 of the lateral drive system 108 being mounted to the block 124 at the second end 128 of the vertical drive system 106. At this position, the lateral drive system 108 substantially avoids interfering with the belt 18 during operation of the treadmill. According to other exemplary embodiments, the longitudinal, vertical, and lateral drive systems may be arranged and interconnected in any manner suitable for substantially fluidly imparting motion having components in any of a combination of directions to the rehabilitee.

Figure 4:
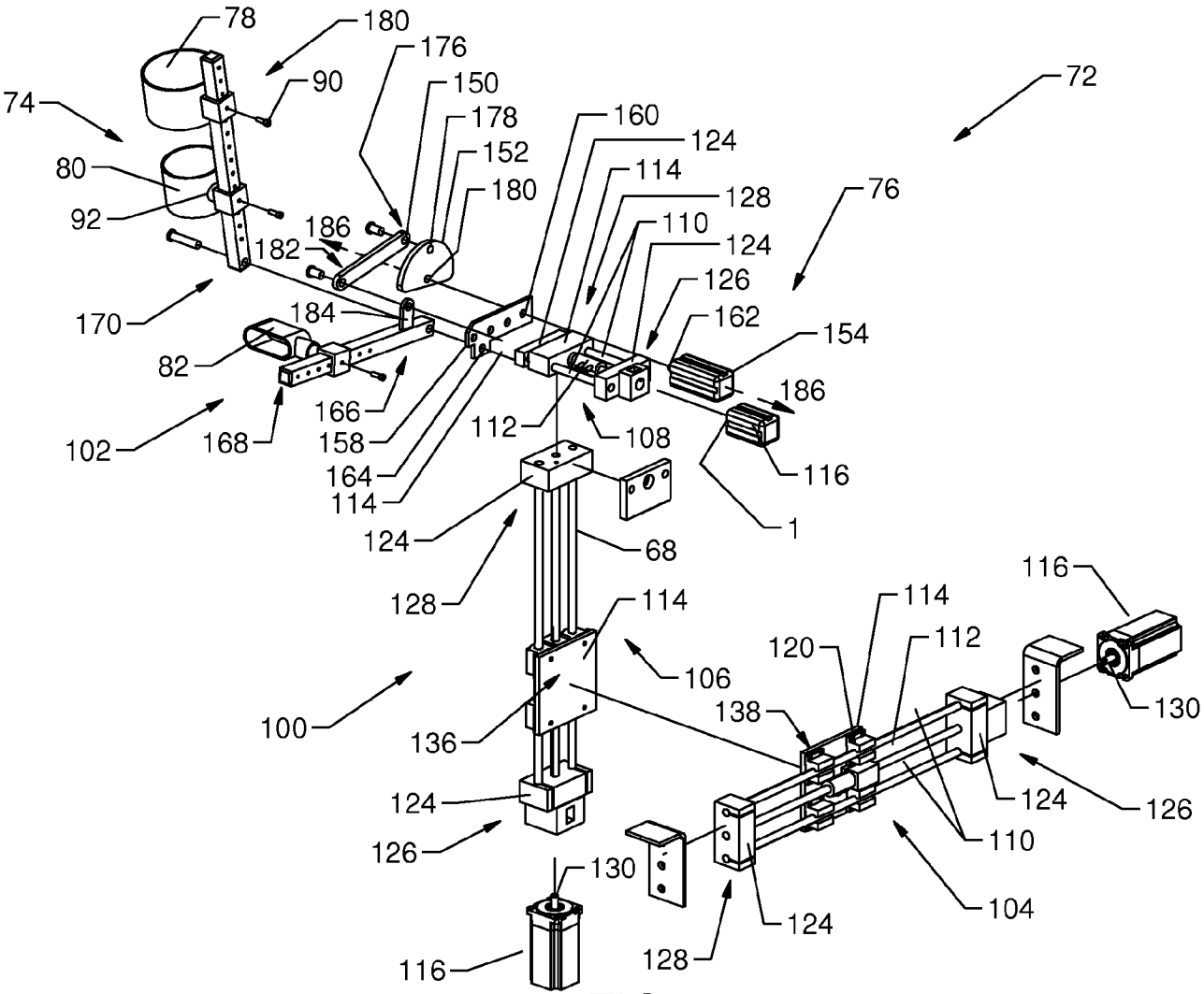
FIG. 4 is an exploded view of a right-hand structure of the walking rehabilitation device according to the exemplary embodiment shown in FIG. 3.

Referring in particular to FIGS. 3 and 4, the ankle articulation drive systems 102 include the pair of first support members 84 and the pair of second support members 86, discussed above, as well as a pair of third support members 150, a pair of fourth support members 152, and a pair of servo motors 154 according to an exemplary embodiment. The ankle articulation drive system 102 is configured to allow the flexure of a person's ankle during a rehabilitation exercise. The ankle articulation drive system is further configured to help control and guide the flexure so that the rehabilitee mimics the natural ankle articulation that occurs during walking. To accomplish this articulation, the servo motor 154 drives the members (e.g., linkages, elements, bars, etc.) of the ankle articulation drive system 102, which are essentially a linkage system according to the exemplary embodiment shown, in response to inputs, which are discussed in more detail below. Allowing and/or helping the rehabilitee's ankles to articulate provides a number of benefits, including, but not limited to, allowing the rehabilitee to perform a desired heel strike and toe off.

Discussing the right-hand structure 72 of the walking rehabilitation system 16 by way of example, the members of the ankle articulation drive systems 102 are coupled to the block 124 at the second end 128 of the lateral drive system 108 by a coupling element, shown as a plate 158 having a plurality of holes. A first hole 160 of the plate 158 receives a shaft 162 of the servo motor 154. The shaft 162 of the servo motor 154 is coupled to and drives the fourth support member 152. A second hole 164 of the plate 158, spaced a distance from the first hole 160, is coupled to the second support member 86 at a first end 166 generally opposite a second end 168 such that the first end 166 of the second support member 86 is able to pivotally move relative to the plate 158. The first support member 84 is also coupled to the plate 158 at the second hole 164, a first end 170 of the first support member 84 also being pivotally movable relative to the plate 158. In addition to being coupled by the plate 158, the fourth support member 152 and second support member 86 are also coupled by the third support member 150. At a first end 176, the third support member 150 is pivotally coupled relative to the fourth support member 152 at a second hole 178 of the fourth support member 152 spaced a distance from a first hole 180, by which the shaft 162 is coupled to the fourth support member 152. At a second end 182, the third support member 150 is pivotally coupled to the second support member 86 at a projection 184.

During operation of the walking rehabilitation device 16, the servo motor 154 is driven in response to inputs. Rotation of the shaft 162 of the servo motor 154 pivotally moves the fourth member 152 about a pivot axis 186 corresponding to the first hole 180 of the fourth member 152. The pivoting motion of the fourth member 152 drives the first end 176 of the third support member 150. As a result, the second end 182 of the third support member 150 drives the first end 166 of the second support member 86 via the projection 184 in a generally arched or curved path. The movement of the first end 166 of the second support member 86 is exaggerated at the second end 168 of the second support member 86. That is, the second end 168 of the second support member 86 moves in a similar, but larger, arched or curved path than the first end 166 of the second support member 86. The second end 168 of the second support member 86 generally corresponds to the location of the ball of the rehabilitee's foot when the walking rehabilitation device 16 is in use. Thus, by causing the second end 168 of the second support member 86 to move generally upward and downward in a generally arched or curved path, rotation of the shaft 162 of the ankle articulation drive systems 102 causes the rehabilitee's foot to articulate generally upward and downward about their ankle.

Similarly, the first end 170 of the first support member 84, which, as mentioned above, is also pivotally coupled to the second end 168 of the second support member 86, causes a second end 180 of the first support member 84 to be driven in an arched or curved path generally larger than the substantially arched or curved path through which the first end 170 of the first member is driven. The substantially arched or curved path through which the second end 180 of the first support member 84 is driven, is generally convex and extends in a direction generally parallel to the longitudinal axis 20. The second end 180 of the first support member 84 generally corresponds to the location of the rehabilitee's shin when the walking rehabilitation device 16 is in use. Accordingly, by causing the second end 180 of the first support member 84 to move in the substantially arched or curved path, the shaft 162 of the ankle articulation drive systems 102 causes the rehabilitee's shin articulate generally forwardly and rearwardly about their ankle. Thus, the ankle articulation drive systems 102 helps the rehabilitee mimic the ankle articulation associated with walking. According to other exemplary embodiments, other ankle articulation drive systems 102 suitable for mimicking the ankle articulation associated with walking may be used.

According to an exemplary embodiment, an ankle articulation drive system is included in the walking rehabilitation device that is mechanically driven, rather than driven by a motor. For example, another member or linkage may be provided that mechanically drives the members of the ankle articulation system in response to motion of one or more of the linear drive systems.

According to an exemplary embodiment, a non-driven ankle articulation system may be incorporated into the user engagement structure of the walking rehabilitation device. Generally, the non-driven ankle articulation systems are configured to avoid restricting the motion of the wearer's ankle, and, thereby, allowing for natural articulation of the user's ankle during a rehabilitation exercise. Such movement may be facilitated by a plurality of pivotally interconnected members.

According to an exemplary embodiment, the drive systems (e.g., linear drive systems and/or the ankle articulation drive systems) can be any system or assembly that drives or introduces motion in a given direction or along a given path. For example, other possible drive systems may include any number of linkages (e.g., 3, 5, 6, 7, etc.), belts, cams, and/or chains. Also, a combination of different types of drive systems may be utilized in the walking rehabilitation device.

Figure 5:
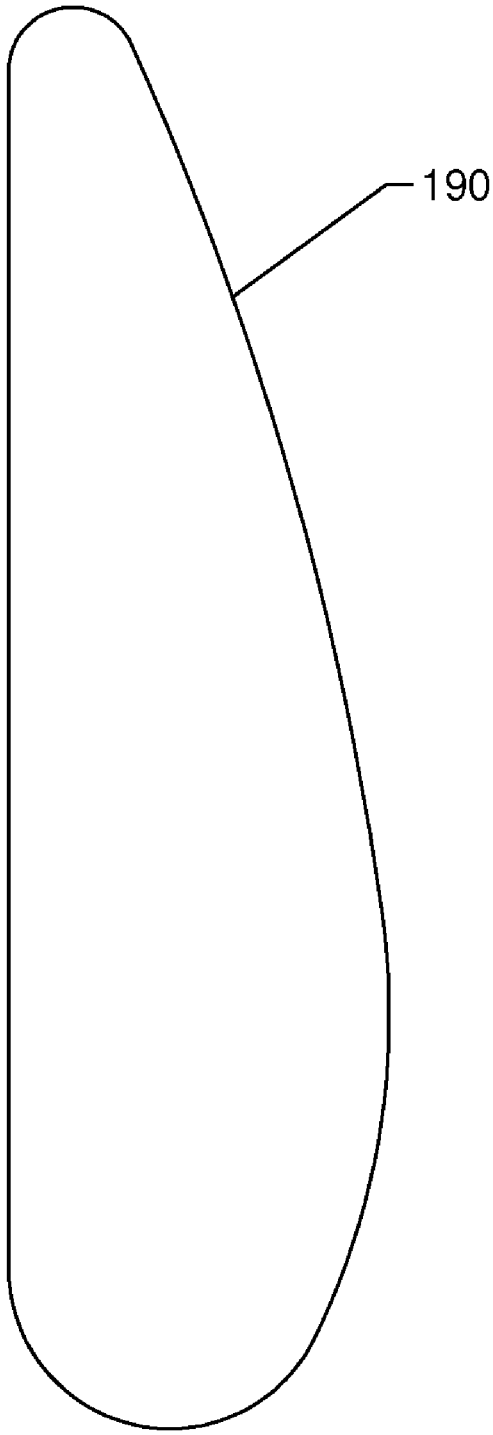
FIG. 5 is a top view of an exemplary right leg gait pattern.
Figure 6:
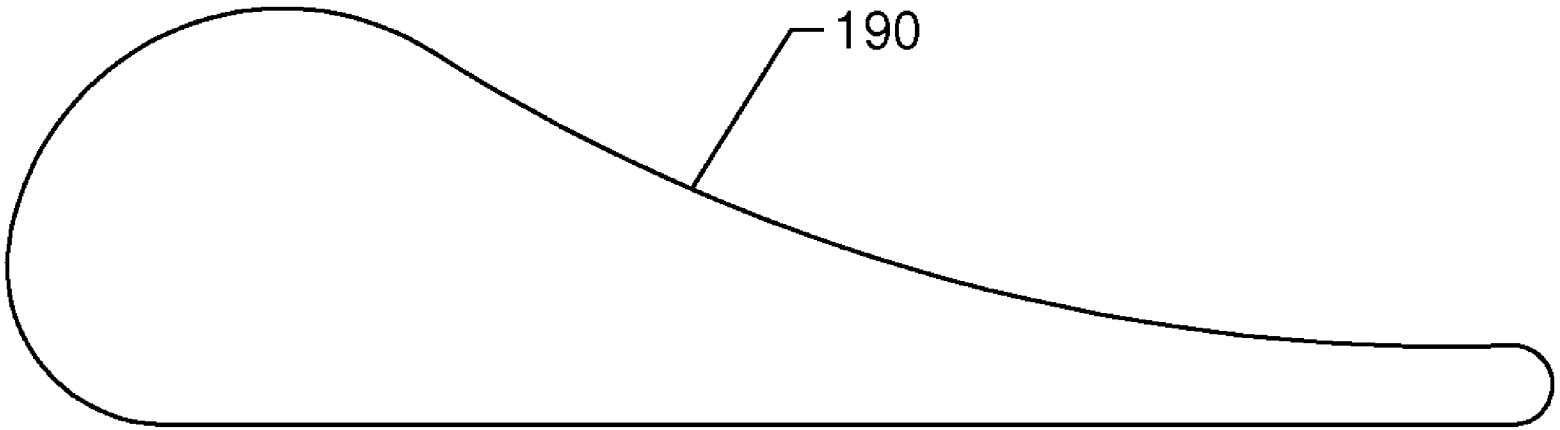
FIG. 6 is a side view of the exemplary right leg gait pattern of FIG. 5.
Figure 7:
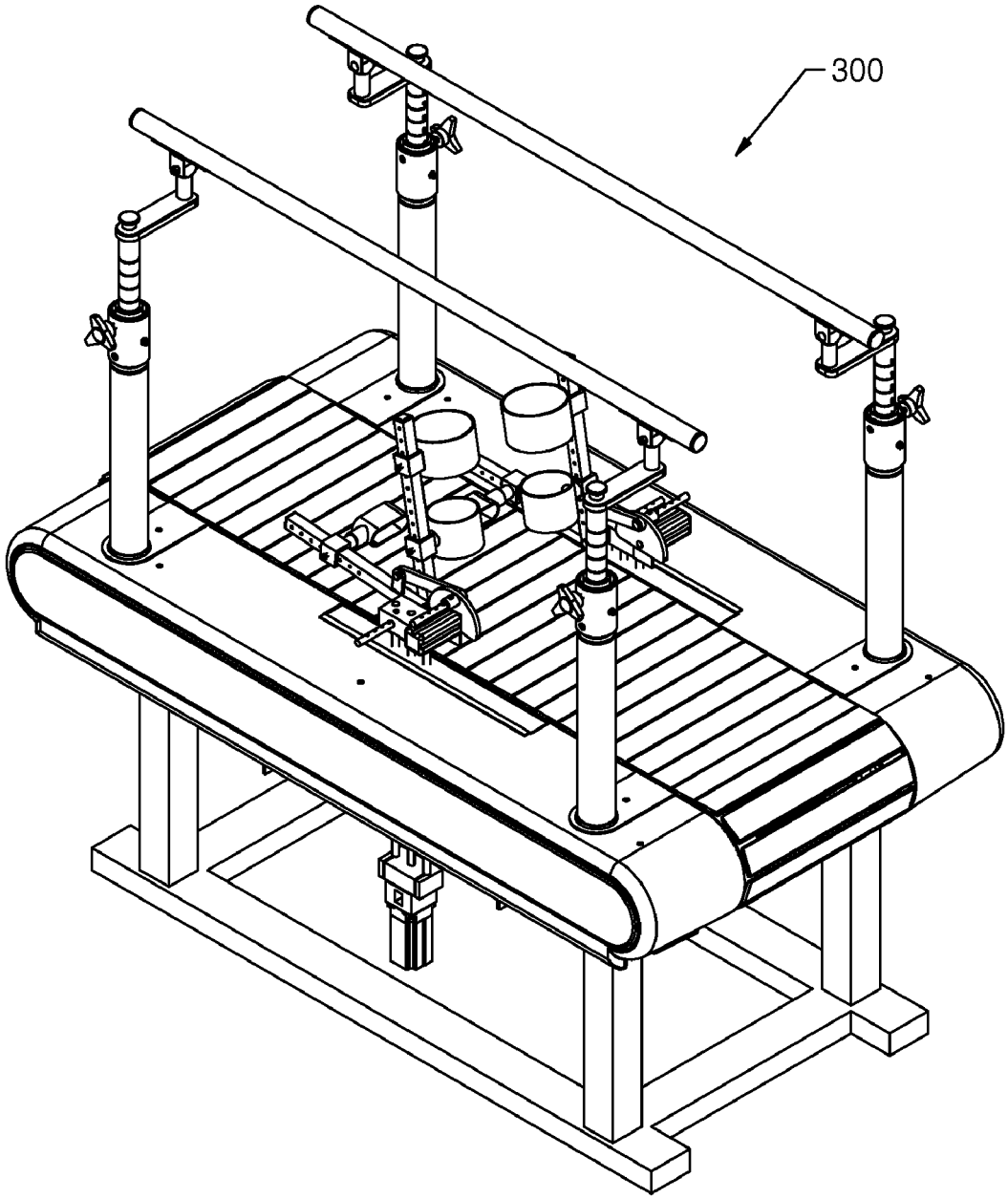
FIG. 7 is a perspective view of another exemplary embodiment of a treadmill including an integrated walking rehabilitation device.
Figure 8:
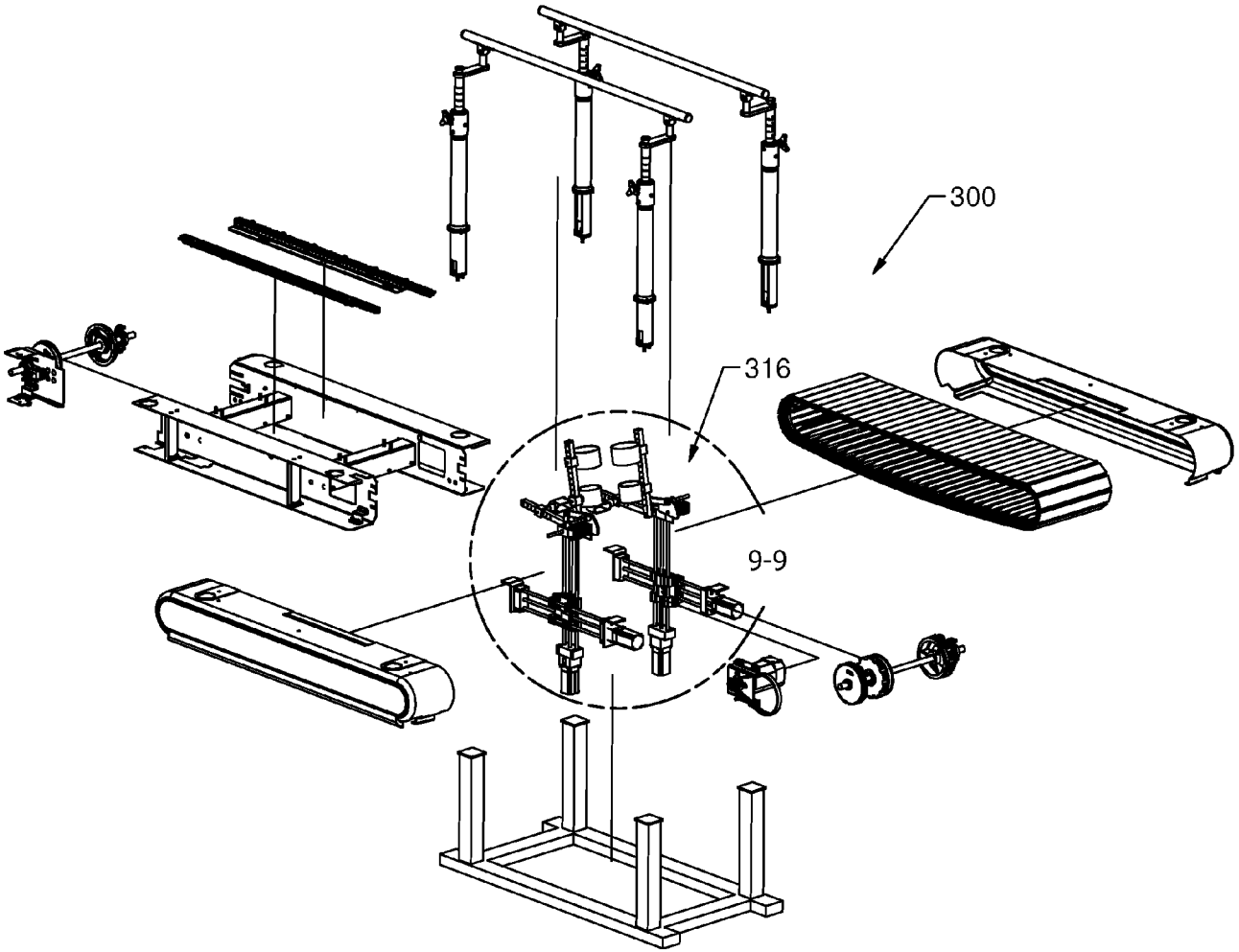
FIG. 8 is an exploded view of the treadmill including an integrated walking rehabilitation device according to the exemplary embodiment shown in FIG. 7.
Figure 9:
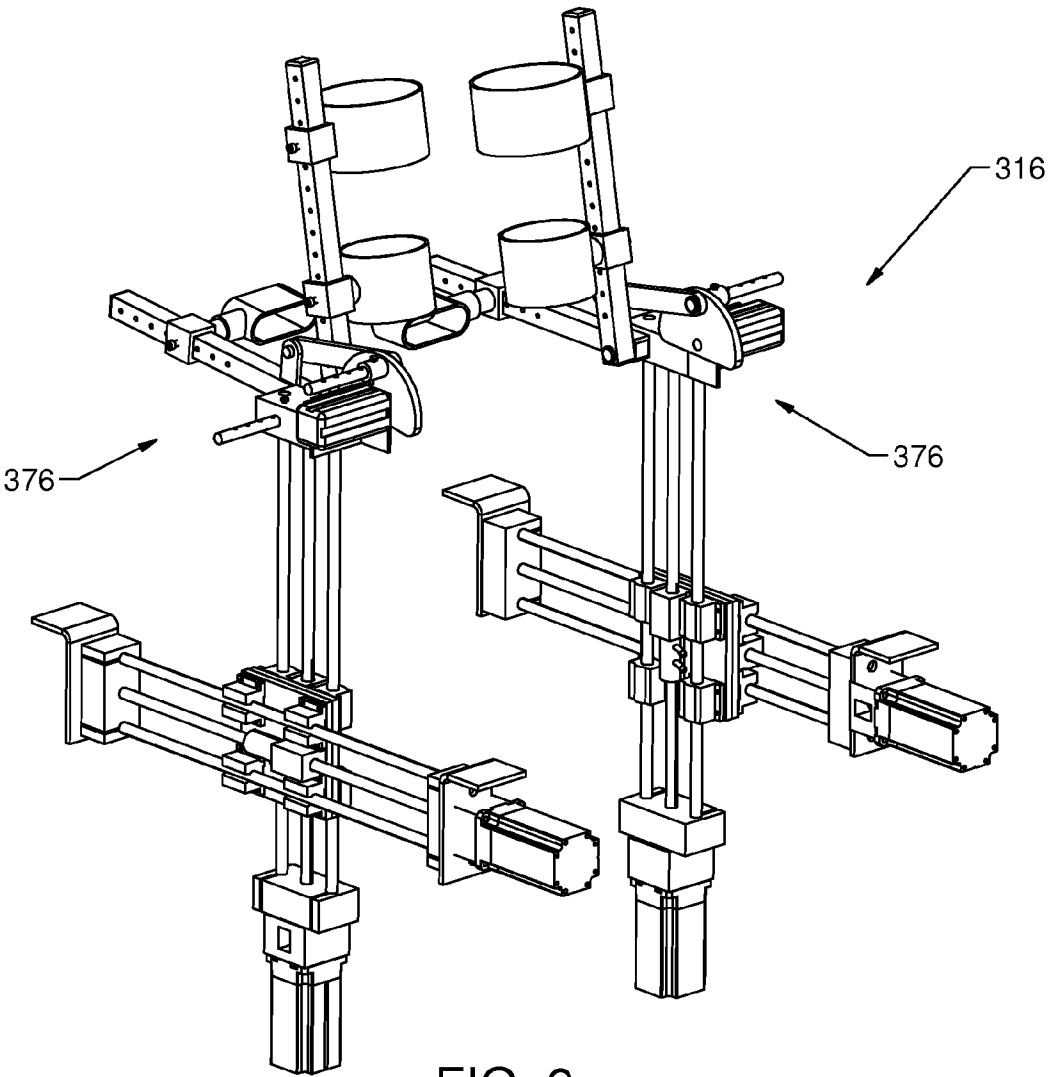
FIG. 9 is a perspective view of a walking rehabilitation device according to the exemplary embodiment shown in FIG. 7.
Figure 10:
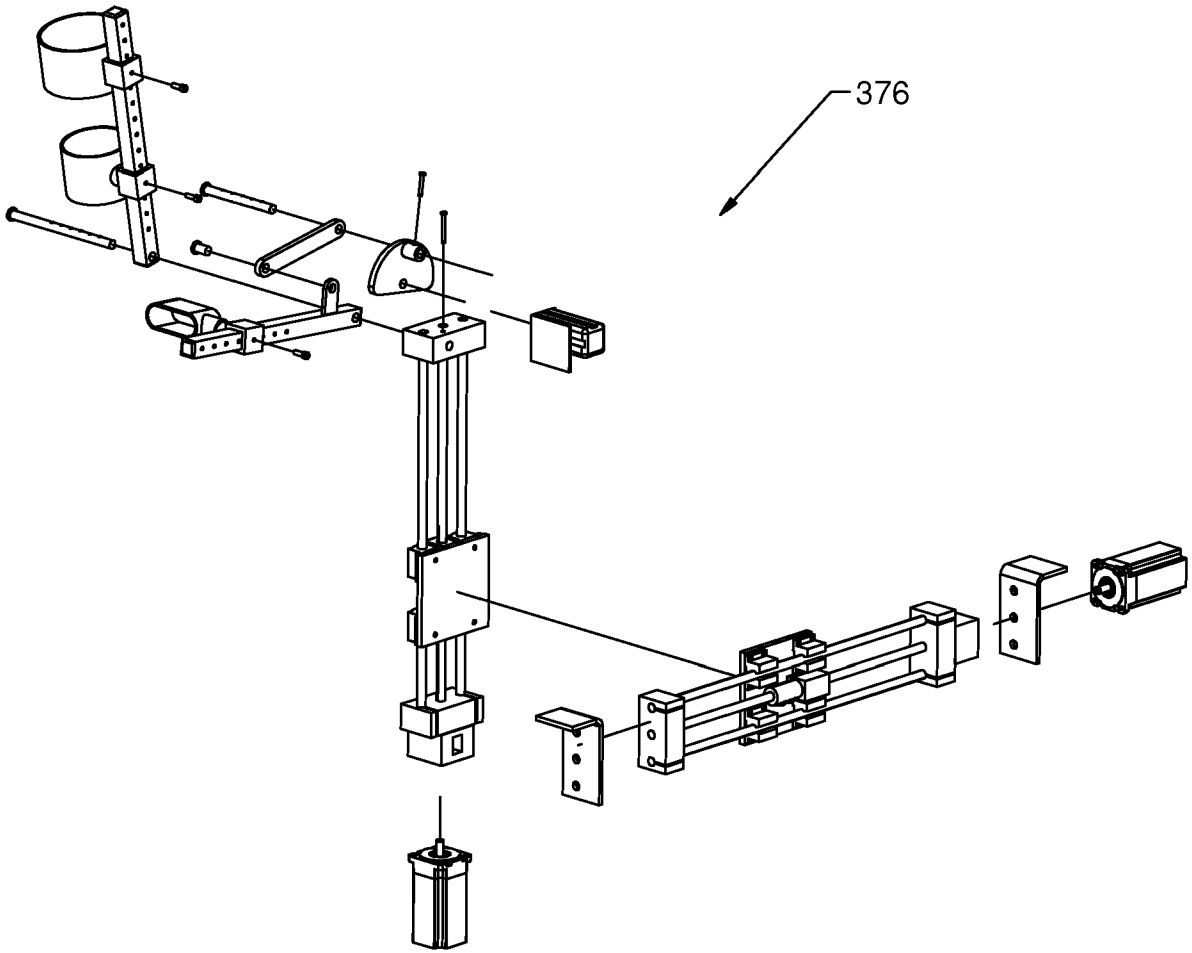
FIG. 10 is an exploded view of a right-hand structure of the walking rehabilitation device according to the exemplary embodiment shown in FIG. 9.

Referring to FIGS. 5 and 6, an exemplary gait pattern 190 is shown from the top and the side according to an exemplary embodiment. The gait pattern seen in FIG. 5 corresponds to a desired gait pattern for the right foot of a rehabilitee. From these views it can be seen that motion in each of the longitudinal, vertical, and lateral directions is utilized to form the desired pattern. It should be noted that, while the lateral control is not necessary for the most basic gait replication, it is desirable because this pattern is a physically correct gait which generally includes some level of motion of a persons foot toward the centerline of their body during the forward swing portion of their gait. Thus, this is one way the walking rehabilitation device 16 provides for a more accurate replication of a desirable gait patterns.

A computing device 200 and a user interface 202 are utilized to provide instructions to the drive systems 76 according to an exemplary embodiment. Among other things, the computing device 200 may be configured to control the gait pattern, sending instructions to each servo motor 116, 154 that indicate the desired the mechanical positions of the guides 114 of the linear drive systems 100 and the desired articulation of the ankle articulation drive systems 102. The gait pattern may be progressive (e.g., having a stride that increases or decreases in length over time), or may be changed to provide for different rehabilitation regimens. According to one exemplary embodiment, the computing device 200 calculates desirable gait patterns for the rehabilitee in response to various inputs. Stated otherwise, the walking rehabilitation device 16 allows for the gait pattern to be customized to the rehabilitee. Some of these inputs may correspond directly to the physical characteristics of the rehabilitee (e.g., their weight, their knee-to-ankle length, hip-to-ankle length, hip-to-knee length, inseam, stride length, height, etc.). Other inputs may correspond more directly to the desired rehabilitation regimen (e.g., the gait pattern, speed, etc). According to some exemplary embodiments, the computing device may be further configured to store data, and, thereby, monitor a given rehabilitee's progress over time. In fact, the computing device may analyze the data and initial inputs to develop and series of training regimens for a rehabilitee to execute over time. It should be noted, that different treadmill computing devices may operate based on different combinations of inputs.

According to any exemplary embodiment, the walking rehabilitation device may include only right-handed elements or left-handed elements. Such a configuration may be particularly useful, for example, for use with rehabilitee's who have experienced more significant neurological damage to one side of their body relative to the other (e.g., as a result of a stroke).

It should be noted that the walking rehabilitation device 16 of the treadmill 10 is not limited to mimicking or replicating walking motions. Numerous other motions beneficial for rehabilitation purposes may be mimicked. For example, kicking motions, knee lifts, etc.

Referring to FIGS. 7-10, another exemplary embodiment of the treadmill is shown as a treadmill 300 including a walking rehabilitation device 316 having a plurality of drive systems 376. The treadmill 300 is substantially similar to the treadmill 10 with the exception that a lateral drive system is not included in the treadmill 10 and the ankle articulation drive systems 102 is coupled to the vertical drive system 106.

Figure 11:
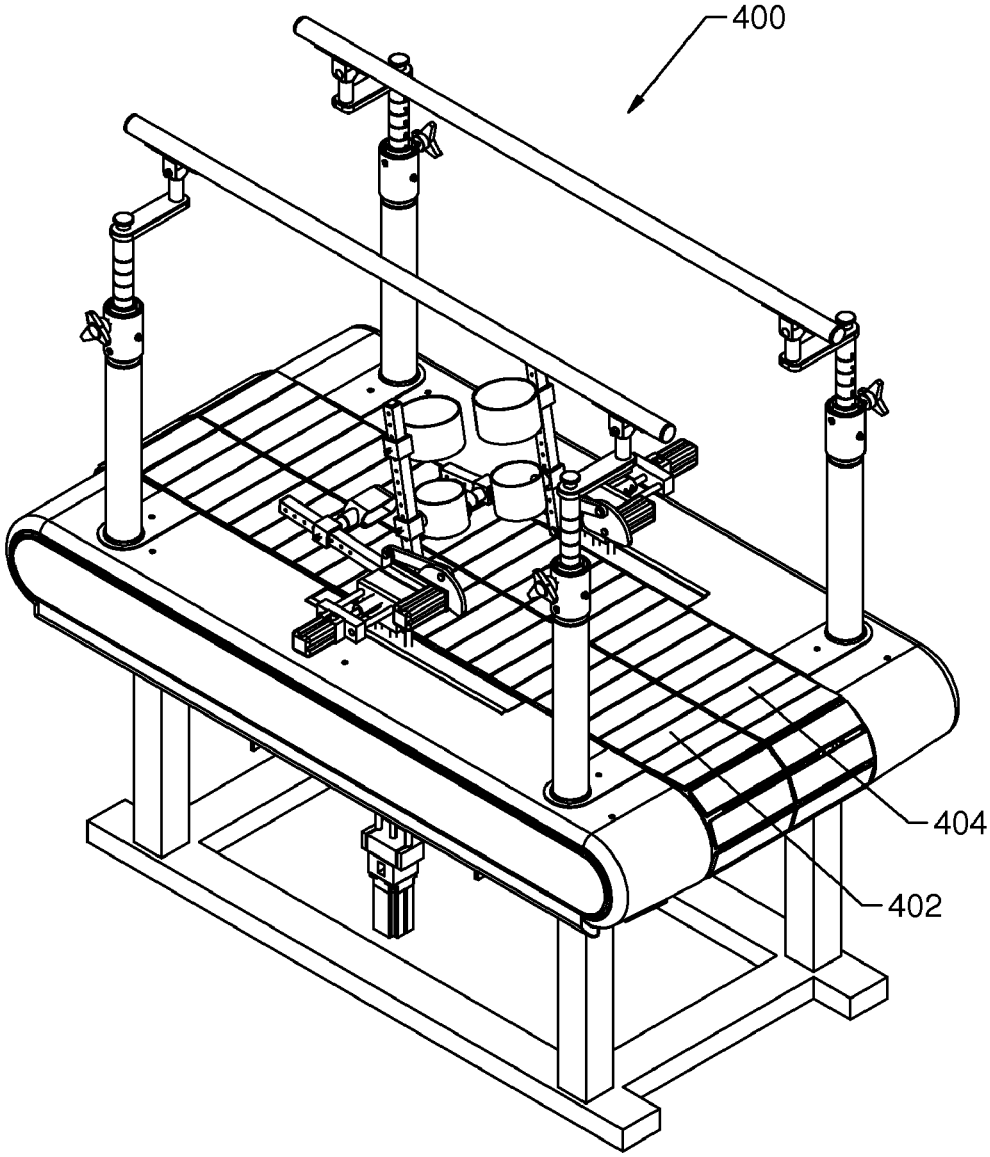
FIG. 11 is another exemplary embodiment of a treadmill including an integrated walking rehabilitation device.

Referring to FIG. 11, another exemplary embodiment of the treadmill is shown as treadmill 400 including a walking rehabilitation device 16. The treadmill 400 includes two belts 402, 404, one corresponding to the left-hand side of a user and the other corresponding to the right-hand side of the user. Stated otherwise, the treadmill 400 is a split-belt treadmill.

According to an exemplary embodiments, one or more of the linear drive systems may be mechanically driven, rather than being driven by a servo motor.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and are considered to be within the scope of the disclosure.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

For the purpose of this disclosure, the term "coupled" means the joining of two members directly or indirectly to one another. Such joining may be stationary or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It should be noted that the orientation of various elements may differ according to other exemplary embodiments, and that such variations are intended to be encompassed by the present disclosure.

It is important to note that the constructions and arrangements of the treadmill as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A treadmill for providing walking rehabilitation to a rehabilitee, comprising:

a base including a belt; and a walking rehabilitation device interconnected with the base, the walking rehabilitation device comprising:

a user engagement structure extending at least partially above the belt and being configured to be removably secured to one or more locations of a rehabilitee's lower extremities;

a plurality of interconnected drive systems coupled to the user engagement structure, the plurality of drive systems including at least a first drive system and a second drive system, the first drive system controlling the rehabilitee's motion in a first direction and moving the second drive system along a first axis, the second drive system controlling the rehabilitee's motion in a second direction; and one or more motors coupled to and driving the plurality of drive systems;

wherein motion from the plurality of drive systems is transferred to the rehabilitee by the user engagement structure, allowing the rehabilitee to walk along the belt, and the second drive system moves the second drive system relative to the first drive system along a second axis, and wherein the first direction is parallel to the first axis, and the second direction is parallel to the second axis.

2. The treadmill of claim 1, wherein the first drive system comprises a substantially longitudinal drive system and the second drive system comprises a substantially vertical drive system, both drive systems being disposed at one of a left-hand side or a right-hand side of the treadmill.

3. The treadmill of claim 2, wherein the plurality of drive systems further comprises a third drive system on the same side of the treadmill as the first drive system and the second drive system.

4. The treadmill of claim 3, wherein the belt comprises a walking surface, and wherein the third drive system is a lateral drive system controlling the rehabilitee's motion in substantially side-to-side directions relative to the walking surface of the belt.

5. The treadmill of claim 3, wherein the third drive system is an ankle articulation drive system.

6. The treadmill of claim 3, wherein the drive systems on the right-hand side of the treadmill are the mirror image of the drive systems on the left-hand side of the treadmill.

7. The treadmill of claim 1, wherein each drive system includes a guide slidably movable along one or more rails, and wherein one or more of the motors cause the guide to move along the rails.

8. The treadmill of claim 1, further comprising a computing device configured to receive input to control and customize a gait for the rehabilitee.

9. The treadmill of claim 8, further comprising a user interface, the user interface allowing a user to enter one or more inputs that are utilized by the computing device to calculate a desirable gait for the rehabilitee.

10. The treadmill of claim 1, wherein the belt comprises a walking surface, and wherein at least one of the motors driving at least one of the first and second drive systems is located below the walking surface of the belt.

11. The treadmill of claim 1, wherein the first drive system further controls the rehabilitee's motion in a direction substantially opposite the first direction, and the second drive system further controls the rehabilitee's motion in a direction substantially opposite the second direction.

12. A method for providing walking rehabilitation to a rehabilitee, comprising:

providing a treadmill with a base, a belt, and a walking rehabilitation device, the walking rehabilitation device interconnected with the base and including a plurality of drive systems operably interconnected with a user engagement structure;

removably securing the user engagement structure relative to one or more locations of a rehabilitee's lower extremities;

driving the plurality of drive systems with a plurality of servo motors; and imparting motion to the rehabilitee, causing the rehabilitee to walk along the belt with a desirable gait;

wherein the plurality of drive systems includes a first drive system and a second drive system, and wherein during the step of driving the plurality of drive systems, the first drive system remains at a fixed angle relative to the second drive system.

13. The method of claim 12, further comprising the step of providing one or more inputs into a computing device to control and customize the gait for the rehabilitee, the computing device being configured to send instructions to the motors to indicate desired mechanical positions of a plurality of guides of the drive systems.

14. The method of claim 12, wherein the first drive system is a substantially longitudinal drive system and the second drive system is a substantially vertical drive system, and wherein the first and second drive systems are configured to provide motion of the user engagement structure in substantially linear directions.

15. The method of claim 14, wherein the belt comprises a walking surface, and wherein the plurality of drive systems includes a third drive system configured to provide side-to-side motion of the user engagement structure relative to the walking surface of the belt.

16. A treadmill for providing walking rehabilitation to a rehabilitee, comprising:

a base including a belt; and a walking rehabilitation device interconnected with the base, the walking rehabilitation device comprising:

a user engagement structure extending at least partially above the belt and being configured to be removably secured to one or more locations of a rehabilitee's lower extremities;

a plurality of interconnected drive systems coupled to the user engagement structure, the plurality of drive systems including at least a first drive system and a second drive system, the first drive system controlling the rehabilitee's motion in a first direction and moving the second drive system along a first axis, the second drive system controlling the rehabilitee's motion in a second direction; and one or more motors coupled to and driving the plurality of drive systems;

wherein motion from the plurality of drive systems is transferred to the rehabilitee by the user engagement structure, allowing the rehabilitee to walk along the belt; and wherein the belt comprises a walking surface, and wherein at least one of the motors driving at least one of the first and second drive systems is located below the walking surface of the belt.

17. The treadmill of claim 16, wherein the first drive system comprises a substantially longitudinal drive system and the second drive system comprises a substantially vertical drive system, both drive systems being disposed at one of a left-hand side or a right-hand side of the treadmill.

18. The treadmill of claim 17, wherein the plurality of drive systems further comprises a third drive system, the third drive system being a lateral drive system controlling the rehabilitee's motion in substantially side-to-side directions relative to the walking surface of the belt.

19. The treadmill of claim 18, wherein the third drive system is on the same side of the treadmill as the first drive system and the second drive system.

20. The treadmill of claim 16, wherein each drive system includes a guide slidably movable along one or more rails, and wherein one or more of the motors cause the guide to move along the rails.

21. The treadmill of claim 16, further comprising a computing device configured to receive input to control and customize a gait for the rehabilitee.

22. The treadmill of claim 16, wherein the first drive system further controls the rehabilitee's motion in a direction substantially opposite the first direction, and the second drive system further controls the rehabilitee's motion in a direction substantially opposite the second direction.

* * * * *